United States Patent [19]

Lazarecky

[11] 4,033,055

[45] July 5, 1977

[54] SNOW REMOVER

[76] Inventor: Vincent Lazarecky, 28882 Gilbert Route, Warren, Mich. 48093

[22] Filed: Aug. 3, 1976

[21] Appl. No.: 711,258

[52] U.S. Cl. ..... 37/16; 37/130; 126/271.2 A; 404/95; 294/55

[51] Int. Cl.[2] ..... E01H 5/10

[58] Field of Search ..... 37/16, 12, 130; 404/79, 404/95; 126/271.1, 271.2 A, 271.2 R, 343.5 R; 294/54, 55

[56] References Cited

UNITED STATES PATENTS

| | | | |
|---|---|---|---|
| 184,628 | 11/1876 | Kendrick | 37/12 |
| 986,946 | 3/1911 | Saxon | 37/12 |
| 1,189,716 | 7/1916 | Matzke | 126/271.1 |
| 1,264,973 | 5/1918 | Powers | 126/271.1 |
| 1,298,200 | 3/1919 | Gorgey | 37/16 |
| 2,996,111 | 8/1961 | Mocerino et al. | 37/16 X |
| 3,053,311 | 9/1962 | Nottage | 37/16 X |
| 3,063,174 | 11/1962 | Ludin | 37/130 |
| 3,174,477 | 3/1965 | Wilson | 37/16 X |
| 3,331,297 | 7/1967 | Bettino | 404/95 |
| 3,509,871 | 5/1970 | Maille | 126/271.2 A |

FOREIGN PATENTS OR APPLICATIONS

| | | | |
|---|---|---|---|
| 646,319 | 11/1950 | United Kingdom | 404/95 |

*Primary Examiner*—E. H. Eickholt

[57] ABSTRACT

A snow removal machine that comprises a carriage assembly including ground engaging supporting wheels connected to and disposed beneath the carriage assembly and a handle extending from one end of the carriage assembly for manual control of the snow removal machine by the user thereof. A snow plow is mounted at the other end of the carriage assembly for engagement with the snow as the snow removal machine is advanced by the user thereof. The snow plow includes a transversely extending scoop having a contoured bottom wall with an outer surface terminating at a leading edge for engagement with the snow and a pair of spaced apart side walls at each end of the bottom wall. Fluid outlet means is mounted relative to the snow plow for providing a continuous application of two paths of heated fluid relative to the scoop, the first path being in a direction extending transversely in front of the leading edge to heat the snow, and the second path being in a direction extending transversely against the outer surface of the scoop to heat same, so as to obtain a continuous and progressive melting of the snow as the snow removal machine is advanced by the user thereof.

9 Claims, 4 Drawing Figures

FIG.1
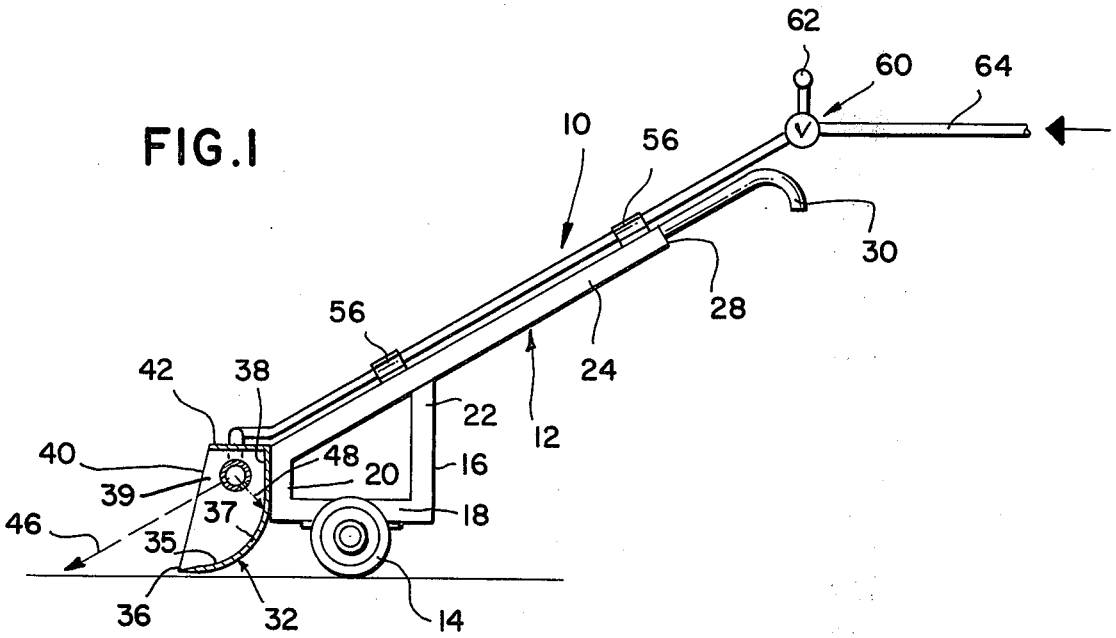
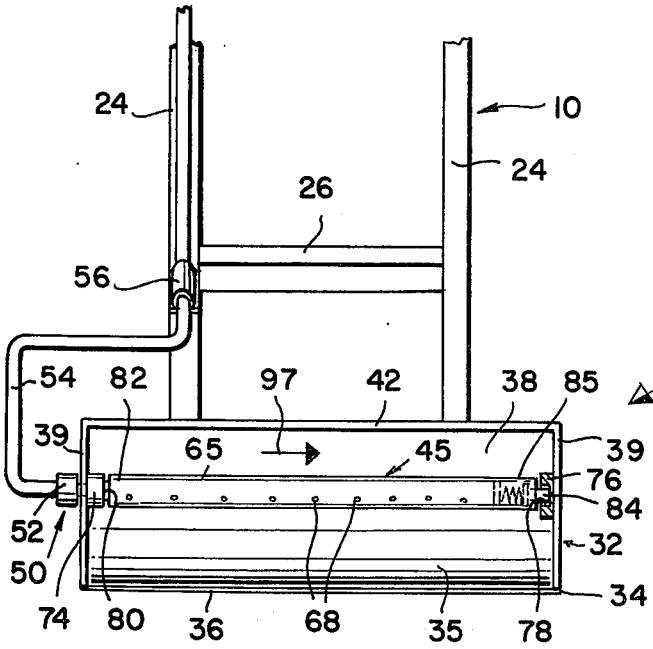
FIG.2
FIG.3
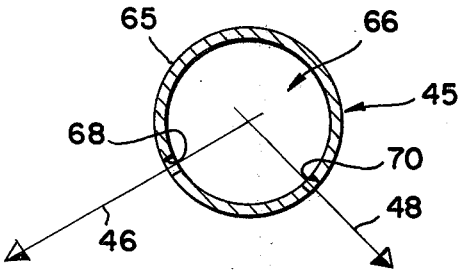
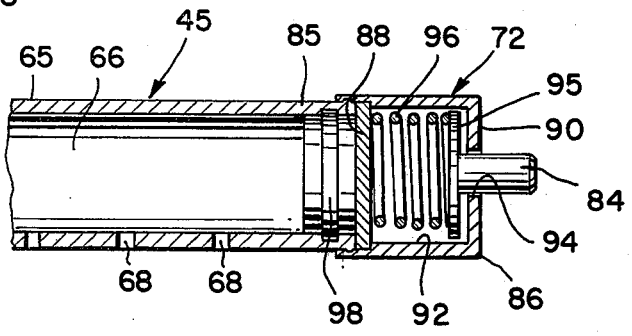
FIG.4

SNOW REMOVER

BACKGROUND OF THE INVENTION

This invention relates to a machine for melting snow and ice and is adapted for use on sidewalks, driveways, roadways, and elsewhere for melting and thus removing accumulations of snow and ice. More particularly the present invention provides a snow removal machine ideally suited for home use that may be connected to a source of hot water readily available by the home user for removing of snow.

OBJECTS OF THE INVENTION

An object of the present invention is to provide a snow removal machine easily manipulated by the user thereof for removing of snow and ice.

Another object of the invention is to provide such a machine of extremely simple construction which may be very economically manufactured and sold, and which will be safe, efficient, and durable.

Other objects and advantages of the present invention will become obvious as the disclosure proceeds.

SUMMARY OF THE INVENTION

A snow removal machine in accordance with the present invention includes a carriage assembly having ground engaging supporting wheels connected to and disposed beneath the carriage assembly and a handle extending from one end of the carriage assembly for manual control of the snow removal machine by the user thereof. A snow plow is mounted at the other end of the carriage assembly for engagement with the snow as the snow removal machine is advanced by the user thereof. The snow plow includes a transversely extending scoop having a contoured bottom wall with an outer surface terminating at a leading edge for engagement with the snow and a pair of spaced apart side walls at each end of the bottom wall.

Fluid outlet means is mounted relative to the snow plow for providing a continuous application of two paths of heated fluid relative to the scoop. The first path being in a direction extending transversely in front of the leading edge to heat the snow, and the second path being in a direction extending transversely against the outer surface of the scoop to heat same, so as to obtain a continuous and progressive melting of the snow as the snow removal machine is advanced by the user thereof. Coupling means is operatively associated with the fluid outlet means for supplying a continuous flow of fluid thereto.

The fluid outlet means includes a fluid member mounted between the side wall with a fluid passageway extending through the fluid member. A first row of spaced apart apertures extends longitudinally along the fluid passageway to form the first flow path, and a second row of spaced apart apertures extends longitudinally along the tubular fluid member in communicating relationship with the fluid passageway and in angular spaced relation to the first row to form the second path.

BRIEF DESCRIPTION OF THE DRAWINGS

Although the characteristic features of this invention will be particularly pointed out in the claims, the invention itself, and the manner in whcih it may be made and used, may be better understood by referring to the following description taken in connection with the accompanying drawings forming a part hereof, wherein like reference numerals refer to like parts throughout the several views and in which:

FIG. 1 is a side elevational view, partly in longitudinal section, illustrating the snow removal machine of the present invention;

FIG. 2 is a front enlarged view, partly in section, illustrating the snow removal machine;

FIG. 3 is an enlarged cross-sectional view of the fluid delivery member; and

FIG. 4 is an enlarged fragmentary sectional view illustrating the structure of the removable mounting of the fluid supply means.

DETAILED DESCRIPTION OF THE DRAWINGS

Referring more specifically to the drawings, the snow removal machine 10 includes a carriage assembly 12 including a pair of spaced apart ground engaging supporting wheels 14 connected to and disposed beneath the frame 16 forming part of the carriage 12. The frame 16 includes a horizontally extending bracket 18, a front vertically extending bracket 20, a rear vertically extending bracket 22, and an upwardly, rearwardly inclined carriage member 24. One or more cross members 26 may retain each side of the carriage in rigidly fixed relation to each other. Extending outwardly from the carriage assembly 12 at the rear end 28 of each carriage member 24 is a handle 30 for manual control of the snow removal machine 10 by the user thereof. The carriage assembly 12 may obviously take many forms or shapes and may be of the power driven type, which automatically propels itself thereby making the job of removing the snow less tedious.

A snow plow 32 is mounted at the end of the frame 16 in spaced relation to the handle 30 and adjacent the front vertically extending bracket 20 in the conventional manner. The snow plow 32 engages the snow as the snow removal machine 10 is advanced by the user thereof. The snow plow 32 includes a transversely extending scoop 34 having a contoured bottom wall 35 with a leading edge 36 and inner surface 37. The leading edge 36 may be beveled or tapered, for engagement with the snow. The bottom wall 35 may be contoured in an arcuate shape and may be integrally formed with a rear wall 38 that has a vertically extending portion that is rigidly joined to the spaced apart vertically extending frame brackets 20.

The scoop 34 further includes a pair of spaced apart side walls 39 that may be upwardly and inwardly inclined having a forward edge 40. An upper wall 42 forms the top of the scoop 34 and may be connected to the side walls 39 and end wall 38. In this manner the scoop 34 is adapted to bite into the snow as the user continuously moves the carriage assembly 12 in a forward direction.

In order to simulataneously obtain a melting of the snow or ice, fluid outlet means 45 is provided and mounted relative to the snow plow 32 in order to provide a continuous application of heated fluid, such as water. The snow removal machine 10 has been found ideally suited for use in conjunction with a hot water source that may be produced in the hot water boiler of the building from which the snow is being removed.

To facilitate the quick and easy removal of the snow, the inventor has found that by providing two paths into which the heated fluid will flow that the beneficial results are obtained. As illustrated with respect in FIGS. 1 and 3, the first path illustrated by arrow 46 is in a direction extending in front of the leading edge 36 to heat and melt the snow as the leading edge 36 is continuously moved forward. Simultaneously therewith a second path in the direction of arrow 48 exists from the fluid outlet means 45 and the second path is in a direction to engage the outer surface 37 of the scoop 34 so as to in effect continuously heat the contoured bottom wall 35 and end wall 38. The first and second paths 46 and 48 is produced transversely between the spaced apart side walls 39.

To provide the continuous flow of heated fluid to the fluid outlet means 45, coupling means 50 is operatively associated therewith in fluid communicating relationship and may include a fluid coupling member 52 having a tubular fluid carrying member 54 exiting therefrom and clamped to the frame 16 by spaced apart clips or clamps 56. The tubing 54 may be made from a metallic or plastic material and terminates in valve control means 60 mounted relative to the handle bars 30 with a control knob 62 thereon to permit the user to regulate the flow of fluid through the fluid outlet means 45. A hose 64 may be removably secured to the valve 60 such that when the snow removal machine 10 is not in use during the summer months the hose 64 may be removed therefrom. It is understood and appreciated that the frame 16 and scoop 34 and related parts may be made out of metal that may be resistive to rust or other well known materials.

The fluid outlet means 45 includes a transversely extending fluid delivery tubular member 65 mounted between the side walls 39 and containing an axially extending fluid passageway 66 that permits the flow of the fluid therethrough. A first row of spaced apart apertures 68 extend longitudinally along the tubular member 65 in communicating relationship with the fluid passageway 66 to form the first flow path illustrated by arrow 46.

A second row of spaced apart apertures 70 extends longitudinally along the tubular fluid member 65 in communicating relationship with the fluid passageway 66 and in angular spaced relation to the first row of apertures 68. The angular spacing between the first row of apertures 68 and second row of apertures 70 is at least 90°. In this manner heated water jets outward in the direction of the snow in anticipation of being engaged by the scoop 34 and simultaneously the scoop 34 is continuously heated by the fluid exiting through the aperture 70 to define the second path as illustrated by arrow 48.

To facilitate removal of the fluid member 45, removable mounting means 72 is provided as illustrated in FIG. 4. The removable mounting means permits the user to replace the fluid member 65 for whatever reason is desired. The removable mounting means 72 includes a pair of spaced apart support members 74 and 76 mounted on the respective side walls 39 and each having a recess 78 in opposed and axially aligned relationship to each other. A shaft member 80 extends outwardly from one end 82 of the fluid member 65 to be received within the recess provided by the support member 74. Another shaft member 84 extends outwardly from the other end 85 of the fluid member 65 in telescopic adjustable relation to the support member 76 so as to be compressed inwardly for release from a recess. The support member 74 and shaft 80 are in communicating relation with the fluid passageway 66 and with the coupling means 50 to permit a continuous flow of fluid therein.

A housing 86 is mounted in fixed relationship to the end 85 of fluid member 65. The housing has spaced apart end walls 88 and 90 with a bore 92 therein with an opening 94 extending through wall 90. A face plate 95 is mounted in the bore 92 with the shaft member 84 coupled thereto and extending outwardly from the opening 94. A spring 92 is mounted within the axial bore 92 between the wall 88 and the face plate 95 to apply an outwardly directed force to the shaft 84. This force may be overcome by manually pushing the fluid member 65 in the direction of arrow 97 such that the spring 96 is compressed to a sufficient axial length to release the shaft 80 at the other end from the mating recess in support member 74. A closure member 98 is positioned in the passageway 66 at the end 85 such that the passageway 66 remains fluid tight except for the flow exiting from the apertures 68 and 70.

In this manner the snow removal machine 10 may be easily and conveniently hooked up to a source of hot water and made operational almost instantly. When use of the device is completed, the fluid member 65 may be removed for cleaning in accordance with the manner described above.

Although an illustrative embodiment of the invention has been described in detail herein with reference to the accompanying drawings, it is to be understood that the invention is not limited to the precise embodiment, and that various changes and modifications may be effected therein without departing from the scope or spirit of the invention.

I claim:

1. A snow removal machine, comprising:

a. a carriage assembly including ground engaging supporting wheels connected to and disposed beneath said carriage assembly and a handle extending from one end of said carriage assembly for manual control of the snow removal machine by the user thereof, b. a snow plow mounted at the other end of said carriage assembly for engagement with the snow as the snow removal machine is advanced by the user thereof, said snow plow including a transversely extending scoop having a contoured bottom wall with an outer surface terminating at a leading edge for engagement with the snow and a pair of spaced apart side walls at each end of said bottom wall, c. fluid outlet means mounted relative to said snow plow for providing a continuous application of two paths of heated fluid relative to said scoop, the first path being in a direction extending transversely in front of said leading edge to heat the snow, and the second path being in a direction extending transversely against said outer surface of said scoop to heat same, so as to obtain a continuous and progressive melting of the snow as the snow removal machine is advanced by the user thereof, said fluid outlet means includes:

1. a fluid member mounted between said side walls,
2. a fluid passageway extending through said fluid member,
3. a first row of spaced apart apertures extending longitudinally along said fluid member in communicating relationship with said fluid passageway to form said first flow path, and
4. a second row of spaced apart apertures extending longitudinally along said fluid member in communicating relationship with said fluid passageway and in angular spaced relation to said first row, to form said second path, and d. coupling means operatively associated with said fluid outlet means for supplying a continuous flow of fluid thereto.

2. A snow removal machine as defined in claim 1, wherein said scoop further includes:

a. an end wall integrally formed with said bottom wall at one end thereof and extending between said side walls, and b. an upper wall enclosing the top of said scoop and connecting said end wall and said spaced apart side walls.

3. A snow removal machine as defined in claim 1, wherein the angular spacing between said first and second rows is at least 90 °.

4. A snow removal machine as defined in claim 1, and further including removable mounting means for detaching said fluid member from between said side walls.

5. A snow removal machine as defined in claim 4, wherein said removable mounting means includes:

a. a pair of spaced apart support members mounted on said side walls, each having a recess in opposed and axially aligned relationship to each other, b. a shaft member extending outwardly of said fluid member at each end thereof for positionment in each said recess, c. one of said shaft members and said support members communicating with said fluid passageway and said coupling means, and d. said other shaft member mounted in telescopic adjustable relation to said shaft member so as to be compressed inwardly for release from a recess.

6. A snow removal machine as defined in claim 5, wherein said other shaft member includes:

a. a housing having a bore therein with an opening on one wall thereof, b. a face plate mounted in said bore with said shaft member coupled thereto and extending outwardly from opening, and c. a spring mounted within said bore between said housing and said face plate to apply an outwardly directed force to said shaft, such that the force may be overcome by movement of said fluid member in the direction of said housing to release the spaced apart support member from its recess.

7. A snow removal machine as defined in claim 1, and further including valve control means operatively connected to said coupling means and said carriage means so as to permit the user to regulate the flow of fluid through said fluid outlet means.

8. A snow removal machine, comprising:

A. a carriage assembly including ground engaging supporting wheels connected to and disposed beneath said carriage assembly and a handle extending from one end of said carriage assembly for manual control of the snow removal machine by the user thereof, B. a snow plow mounted at the other end of said carriage assembly for engagement with the snow as the snow removal machine is advanced by the user thereof, said snow plow including a tranversely extending scoop having a contoured bottom wall with an outer surface terminating at a leading edge for engagement with the snow and a pair of spaced apart side walls at each end of said bottom wall, C. fluid outlet means mounted relative to said snow plow for providing a continuous application of two paths of heated fluid relative to said scoop, the first path being in a direction extending transversely in front of said leading edge to heat the snow, and the second path being in a direction extending transversely against said outer surface of said scoop to heat same, so as to obtain a continuous and progressive melting of the snow as the snow removal machine is advanced by the user thereof, D. coupling means operatively associated with said fluid outlet means for supplying a continuous flow of fluid thereto, E. said fluid outlet means includes:

a. a fluid member mounted between said side walls, b. a fluid passageway extending through said fluid member, c. a first row of spaced apart apertures extending longitudinally along said fluid member in communicating relationship with said fluid passageway to form said first flow path, and d. removable mounting means for detaching said fluid member from between said side walls, said removable mounting means including:

i. a pair of spaced apart support members mounted on said side walls, each having a recess in opposed and axially aligned relationship to each other, ii. a shaft member extending outwardly of said fluid member at each end thereof for positionment in each said recess, iii. one of said shaft members and said support members communicating with said fluid passageway and said coupling means, and iv. said other shaft member mounted in telescopic adjustable relation to said shaft member so as to be compressed inwardly for release from a recess.

9. A snow removal machine as defined in claim 8, wherein said other shaft member includes:

a. a housing having a bore therein with an opening on one wall thereof, b. a face plate mounted in said bore with said shaft member coupled thereto and extending outwardly from opening, and c. a spring mounted within said bore between said housing and said face plate to apply an outwardly directed force to said shaft, such that the force may be overcome by movement of said fluid member in the direction of said housing to release the spaced apart support member from its recess.

* * * * *